US009522563B1

(12) United States Patent
Montgomery, III

(10) Patent No.: US 9,522,563 B1
(45) Date of Patent: Dec. 20, 2016

(54) COMBINED UMBRELLA AND PEN SYSTEM

(71) Applicant: Samuel Montgomery, III, Hampton, VA (US)

(72) Inventor: Samuel Montgomery, III, Hampton, VA (US)

( * ) Notice: Subject to any disclaimer, the term of this patent is extended or adjusted under 35 U.S.C. 154(b) by 0 days.

(21) Appl. No.: 14/845,791

(22) Filed: Sep. 4, 2015

(51) Int. Cl.
*A45B 23/00* (2006.01)
*B43K 29/00* (2006.01)
*A45B 25/00* (2006.01)
*B43K 7/12* (2006.01)

(52) U.S. Cl.
CPC ..... *B43K 29/00* (2013.01); *A45B 23/00* (2013.01); *A45B 25/00* (2013.01); *B43K 7/12* (2013.01); *A45B 2023/0006* (2013.01); *A45B 2200/00* (2013.01)

(58) Field of Classification Search
CPC ... A45B 3/00; A45B 23/00; A45B 2200/1009; A45B 19/04; A45B 19/10; A45B 2009/00; A45B 2019/002; A45B 25/287; A45B 2009/007; A45B 25/28; A45B 25/00; B43K 29/00; B43K 7/12
USPC ..... 135/15.1, 16, 19, 25.1, 34.2, 44, 48; 401/186, 188 A, 195
See application file for complete search history.

(56) References Cited

U.S. PATENT DOCUMENTS 868,326 A * 10/1907 Casale ..... A45B 19/06 135/25.41
892,813 A * 7/1908 Dolles ..... A45B 25/24 135/25.31
1,455,410 A * 5/1923 Posselt ..... A45B 19/10 135/25.31
1,885,968 A * 11/1932 Wedemann ..... A45B 19/10 135/25.32
2,282,695 A 5/1942 Badovinac
3,538,928 A 11/1970 Price
3,954,117 A 5/1976 Wallace
D345,645 S 4/1994 Good
5,421,460 A * 6/1995 Bosshard ..... B25F 1/00 206/223
5,425,388 A * 6/1995 Chen ..... A45B 25/28 135/34.2
6,334,454 B1 * 1/2002 Williams ..... A45B 25/24 135/18
D466,280 S 12/2002 Ko
7,600,938 B2 * 10/2009 Kobayashi ..... B43K 1/088 401/188 A
7,967,463 B2 * 6/2011 Chen ..... B43K 29/10 362/118
8,011,379 B2 9/2011 Oh
8,297,295 B2 10/2012 Banerjee
2007/0048067 A1 * 3/2007 Gerules ..... B43K 23/001 401/195
2008/0175650 A1 * 7/2008 Geddes ..... B43K 23/001 401/195
2013/0272772 A1 * 10/2013 Lee ..... G09F 19/06 401/195

FOREIGN PATENT DOCUMENTS

WO WO2008094020 8/2008

* cited by examiner

*Primary Examiner* — Winnie Yip

(57) ABSTRACT

A combined umbrella and pen system includes an umbrella that has a shaft unit and a canopy unit. The canopy unit is selectively deployed from the shaft unit thereby facilitating the canopy unit to block precipitation. A writing unit is coupled to the canopy unit and the writing unit may be utilized to write.

10 Claims, 4 Drawing Sheets

COMBINED UMBRELLA AND PEN SYSTEM

BACKGROUND OF THE DISCLOSURE

Field of the Disclosure

The disclosure relates to umbrella devices and more particularly pertains to a new umbrella device that combines a writing utensil with a telescopic umbrella.

SUMMARY OF THE DISCLOSURE

An embodiment of the disclosure meets the needs presented above by generally comprising an umbrella that has a shaft unit and a canopy unit. The canopy unit is selectively deployed from the shaft unit thereby facilitating the canopy unit to block precipitation. A writing unit is coupled to the canopy unit and the writing unit may be utilized to write.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
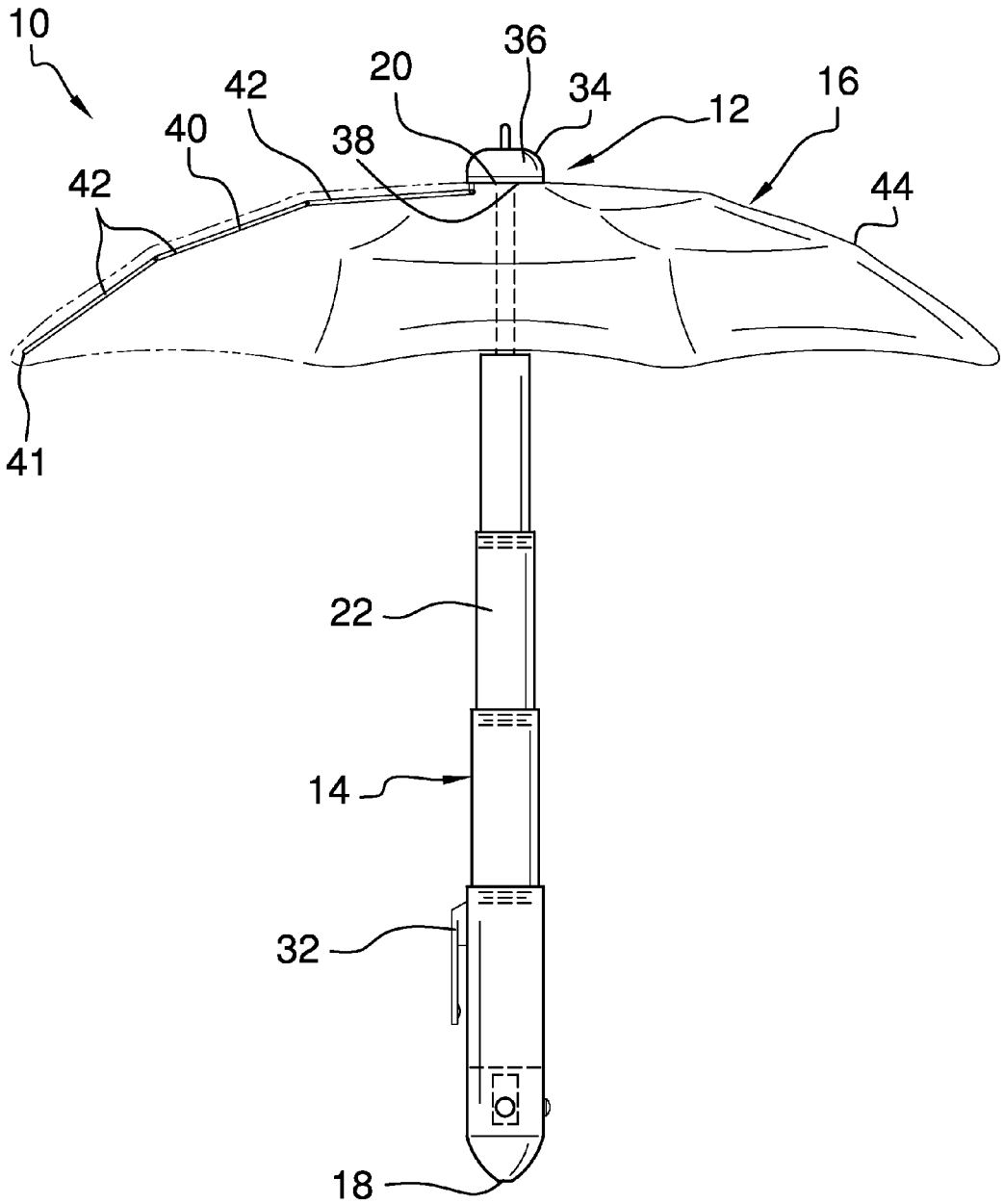
FIG. 1 is a perspective view of a combined umbrella and pen system according to an embodiment of the disclosure.
Figure 2:
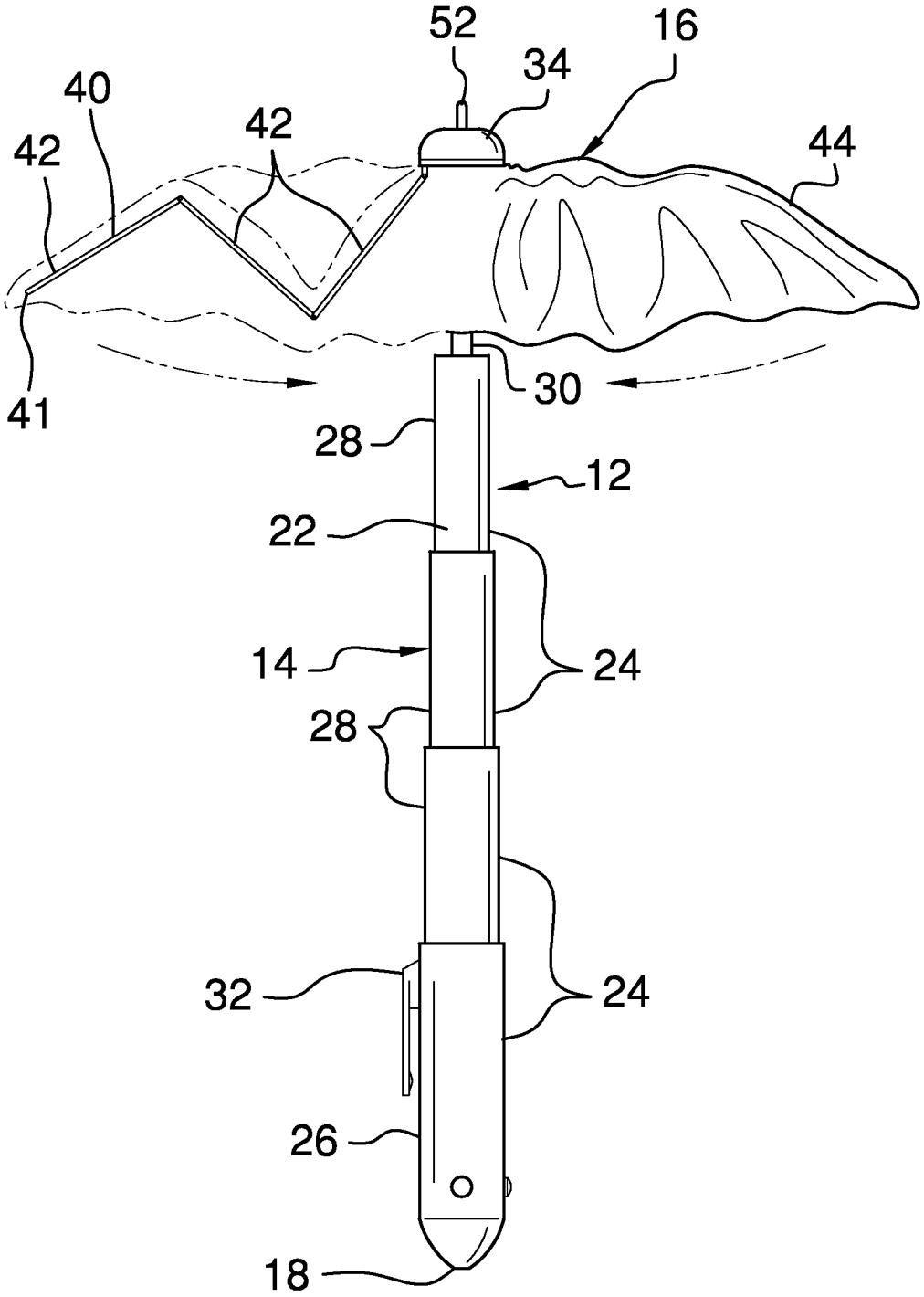
FIG. 2 is a front view of an embodiment of the disclosure showing a canopy in a deployed position.
Figure 3:
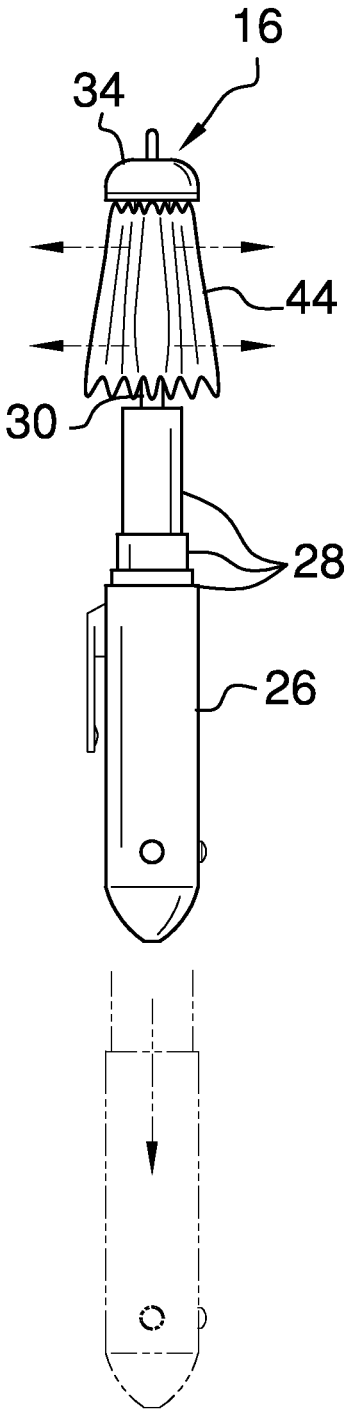
FIG. 3 is a front view of an embodiment of the disclosure showing the canopy in a stored position.
Figure 4:
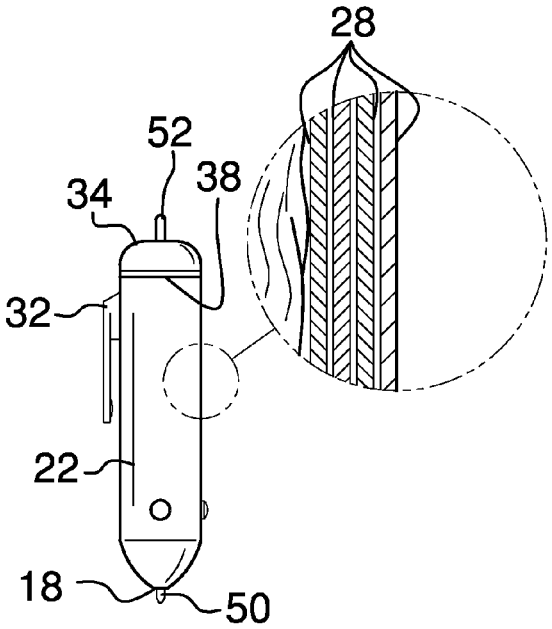
FIG. 4 is a front view of an embodiment of the disclosure showing a shaft unit in a stored position.
Figure 5:
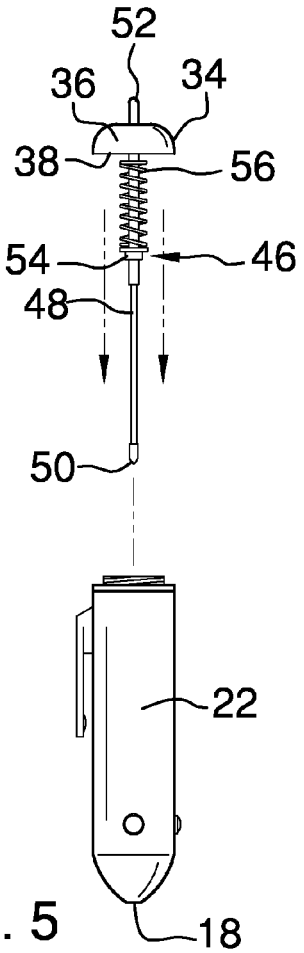
FIG. 5 is an exploded front view of an embodiment of the disclosure.

With reference now to the drawings, and in particular to FIGS. 1 through 5 thereof, a new umbrella device embodying the principles and concepts of an embodiment of the disclosure and generally designated by the reference numeral 10 will be described.

As best illustrated in FIGS. 1 through 5, the combined umbrella and pen system 10 generally comprises an umbrella 12 that has a shaft unit 14 and a canopy unit 16. The canopy unit 16 is selectively deployed from the shaft unit 14 such that the canopy unit 16 blocks precipitation. The shaft unit 14 has a bottom end 18, a top end 20 and a peripheral wall 22 extending between the bottom end 18 and the top end 20. The top end 20 and the bottom end 18 are open and the peripheral wall 22 is curved such that the shaft unit 14 has a cylindrical shape.

The shaft unit 14 comprises a plurality of sections 24. Each of the sections 24 is slidably coupled together such that the shaft unit 14 has a telescopically adjustable length. Each of the sections 24 has a decreasing diameter between the top end 20 and the bottom end 18. The sections 24 include a bottom section 26, a plurality of medial sections 28 and a top section 30.

The sections 24 are positioned in a stored position having each of the medial sections 28 and the top section 30 being contained within the bottom section 26. Each of the medial sections 28 and the top section 30 are positionable in a deployed position having each of the medial sections 28 and the top section 30 extending upwardly from the bottom section 26. The bottom section 26, each of the medial sections 28 and the top section 30 frictionally engage each other such that the sections 24 are retained in the deployed position. The sections 24 may frictionally engage each other through threads, tabs and grooves or any other conventional means of frictional engagement. The peripheral wall 22 corresponding to the bottom section 26 tapers inwardly toward the bottom end 18 of the shaft unit 14.

A clip 32 is coupled to the peripheral wall 22 corresponding to the bottom section 26. The clip 32 selectively engages an article of clothing such that the umbrella 12 is retained on the article of clothing. The clip 32 engages the article of clothing when the shaft unit 14 is positioned in the stored position.

The canopy unit 16 comprises a cap 34 that has an outer wall 36 and a bottom edge 38. The outer wall 36 is curved such that the cap 34 has a hemispherical shape. The bottom edge 38 threadably engages the bottom section 26 when the medial sections 28 and the top section 30 are positioned in the stored position. The cap 34 engages the top end 20 of the shaft unit 14 when the sections 24 are positioned in the deployed position.

A plurality of arms 40 is provided and each of the arms 40 is hingedly coupled to the outer wall 36. The arms 40 are radially distributed around the cap 34 and each of the arms 40 has a distal end 41 with respect to the cap 34. Each of the arms 40 has a plurality of portions 42. Each of the portions 42 is hingedly coupled together such that each of the arms 40 is positionable in a collapsed position and a deployed position.

Each of the arms 40 extends downwardly from the cap 34 when the arms 40 are positioned in the collapsed position. Each of the arms 40 is contained within the top section 30 when the cap 34 is coupled to the bottom section 26. Each of the arms 40 extends laterally away from the cap 34 when the arms 40 are positioned on the deployed position. The arms 40 are positioned in the deployed position after the shaft unit 14 is positioned in the deployed position.

A canopy 44 is coupled to each of the arms 40. The canopy 44 extends between the bottom edge 38 of the cap 34 and the distal end 41 of each of the arms 40. The canopy 44 is comprised of a fluid impermeable material. Thus, the canopy 44 blocks the precipitation when the arms 40 are positioned in the deployed position.

A writing unit 46 is coupled to the canopy unit 16. The writing unit 46 may be utilized to write. The writing unit 46 comprises a pen 48 that is coupled to the outer wall 36 of the cap 34 such that the pen 48 extends downwardly from the cap 34. The pen 48 may comprise a ball point ink pen or the like. The pen 48 has a distal end 50 with respect to the cap 34.

The pen 48 includes a button 52 extending upwardly through the cap 34 such that the button 52 may be manipulated. The pen 48 is positioned between an extended position and a retracted position. The pen 48 has a lip 54 extending outwardly from the pen 48 and the lip 54 is positioned closer to the cap 34 than the distal end 50 of the pen 48. The pen 48 is positioned within the bottom section 26 when the cap 34 is coupled to the bottom section 26.

A biasing member 56 is positioned around the pen 48 and the biasing member 56 extends between the lip 54 and the cap 34. The biasing member 56 biases the pen 48 into the retracted position. The distal end 50 of the pen 48 extends outwardly from the bottom section 26 when the pen 48 is positioned in the extended position. Thus, the pen 48 may be used to write. The pen 48 is contained within the bottom section 26 when the pen 48 is positioned in the retracted position.

In use, the shaft unit 14 is positioned in the stored position and the cap 34 is coupled to the bottom section 26 when the umbrella 12 is to be used to write. The button 52 is manipulated to position the pen 48 in the deployed position thereby facilitating the pen 48 to write. The cap 34 is removed from the bottom section 26 and the shaft unit 14 is positioned in the deployed position when the canopy unit 16 is to be utilized. The cap 34 is coupled to the top section 30 when the shaft unit 14 is positioned in the deployed position. Each of the arms 40 is positioned in the extended position and the canopy 44 is positioned to block the precipitation.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combined umbrella and pen system comprising:

an umbrella having a shaft unit and a canopy unit, said canopy unit being selectively deployed from said shaft unit wherein said canopy unit is configured to block precipitation, said shaft unit including a top end, a bottom section, a pair of medial sections and a top section, said shaft unit being positionable in a stored position and deployed position;

a writing unit being coupled to said canopy unit wherein said writing unit is configured to be utilized to write, said canopy unit comprises a cap having an outer wall and a bottom edge, said outer wall being curved such that said cap has a hemispherical shape, said bottom edge threadably engaging said bottom section when said medial sections and said top section are positioned in said stored position, said cap engaging said top end of said shaft unit when said sections are positioned in said deployed position; and wherein said writing unit comprises a pen being coupled to said outer wall of said cap such that said pen extends downwardly from said cap, said pen having a distal end with respect to said cap, said pen including a button extending upwardly through said cap wherein said button is configured to be manipulated, said pen being positioned between an extended position and a retracted position.

2. The system according to claim 1, wherein said shaft unit has a bottom end, a top end and a peripheral wall extending between said bottom end and said top end, said top end and said bottom end being open, said peripheral wall being curved such that said shaft unit has a cylindrical shape, said shaft unit comprising a plurality of sections, each of said sections being slidably coupled together such that said shaft unit has a telescopically adjustable length, each of said sections having a decreasing diameter between said top end and said bottom end.

3. The system according to claim 2, wherein said sections include a bottom section, a plurality of medial sections and a top section, said sections being positioned in a stored position having each of said medial sections and said top section being contained within said bottom section, each of said medial sections and said top section being positionable in a deployed position having each of said medial sections and said top sections extending upwardly from said bottom section.

4. The system according to claim 3, wherein said bottom section, each of said medial sections and said top section frictionally engage each other such that said sections are retained in said deployed position, said peripheral wall corresponding to said bottom section tapering inwardly toward said bottom end of said shaft unit.

5. The system according to claim 1, further comprising a plurality of arms, each of said arms being coupled to said outer wall, said arms being radially distributed around said cap, each of said arms having a distal end with respect to said cap, each of said arms having a plurality of portions, each of said portions being hingedly coupled together such that each of said arms is positionable in a collapsed position and a deployed position.

6. The system according to claim 5, wherein each of said arms extends downwardly from said cap when said arms is positioned in said collapsed position, each of said arms being contained within said top section when said cap is coupled to said bottom section, each of said arms extending away from said cap when said arms is positioned on said deployed position, said arms being positioned in said deployed position after said shaft unit is positioned in said deployed position.

7. The system according to claim 5, further comprising a canopy being coupled to each of said arms, said canopy extending between said bottom edge of said cap and said distal end of each of said arms wherein said canopy is configured to block the precipitation when said arms is positioned in said deployed position.

8. The system according to claim 1, wherein said pen has a lip extending outwardly from said pen, said lip being positioned closer to said cap than said distal end of said pen, said pen being positioned within said bottom section when said cap is coupled to said bottom section.

9. The system according to claim 8, further comprising a biasing member being positioned around said pen, said biasing member extending between said lip and said cap, said biasing member biasing said pen into said retracted position, said distal end of said pen extending outwardly from said bottom section when said pen is positioned in said extended position wherein said pen is configured to write, said pen being contained within said bottom section when said pen is positioned in said retracted position.

10. A combined umbrella and pen system comprising:

an umbrella having a shaft unit and a canopy unit, said canopy unit being selectively deployed from said shaft unit wherein said canopy unit is configured to block precipitation, said shaft unit having a bottom end, a top end and a peripheral wall extending between said bottom end and said top end, said top end and said bottom end being open, said peripheral wall being curved such that said shaft unit has a cylindrical shape, said shaft unit comprising a plurality of sections, each of said sections being slidably coupled together such that said shaft unit has a telescopically adjustable length, each of said sections having a decreasing diameter between said top end and said bottom end, said sections including a bottom section, a plurality of medial sections and a top section, said sections being positioned in a stored position having each of said medial sections and said top section being contained within said bottom section, each of said medial sections and said top section being positionable in a deployed position having each of said medial sections and said top sections extending upwardly from said bottom section, said bottom section, each of said medial sections and said top section frictionally engaging each other such that said sections are retained in said deployed position, said peripheral wall corresponding to said bottom section tapering inwardly toward said bottom end of said shaft unit, said canopy unit comprising:

a cap having an outer wall and a bottom edge, said outer wall being curved such that said cap has a hemispherical shape, said bottom edge threadably engaging said bottom section when said medial sections and said top section are positioned in said stored position, said cap engaging said top end of said shaft unit when said sections are positioned in said deployed position, a plurality of arms, each of said arms being coupled to said outer wall, said arms being radially distributed around said cap, each of said arms having a distal end with respect to said cap, each of said arms having a plurality of portions, each of said portions being hingedly coupled together such that each of said arms is positionable in a collapsed position and a deployed position, each of said arms extending downwardly from said cap when said arms is positioned in said collapsed position, each of said arms being contained within said top section when said cap is coupled to said bottom section, each of said arms extending away from said cap when said arms is positioned on said deployed position, said arms being positioned in said deployed position after said shaft unit is positioned in said deployed position, and a canopy being coupled to each of said arms, said canopy extending between said bottom edge of said cap and said distal end of each of said arms wherein said canopy is configured to block the precipitation when said arms is positioned in said deployed position; and a writing unit being coupled to said canopy unit wherein said writing unit is configured to be utilized to write, said writing unit comprising:

a pen being coupled to said outer wall of said cap such that said pen extends downwardly from said cap, said pen having a distal end with respect to said cap, said pen including a button extending upwardly through said cap wherein said button is configured to be manipulated, said pen being positioned between an extended position and a retracted position, said pen having a lip extending outwardly from said pen, said lip being positioned closer to said cap than said distal end of said pen, said pen being positioned within said bottom section when said cap is coupled to said bottom section; and a biasing member being positioned around said pen, said biasing member extending between said lip and said cap, said biasing member biasing said pen into said retracted position, said distal end of said pen extending outwardly from said bottom section when said pen is positioned in said extended position wherein said pen is configured to write, said pen being contained within said bottom section when said pen is positioned in said retracted position.

* * * * *